US007716927B2

(12) United States Patent
Williams

(10) Patent No.: US 7,716,927 B2
(45) Date of Patent: May 18, 2010

(54) STIRLING ENGINE ASSEMBLY

(75) Inventor: John Stephen Williams, Bromsgrove (GB)

(73) Assignee: Microgen Engine Corporation Holding B.V., ULFT (NL)

( * ) Notice: Subject to any disclaimer, the term of this patent is extended or adjusted under 35 U.S.C. 154(b) by 925 days.

(21) Appl. No.: 10/581,145

(22) PCT Filed: Dec. 6, 2004

(86) PCT No.: PCT/GB2004/005118

§ 371 (c)(1),
(2), (4) Date: May 31, 2006

(87) PCT Pub. No.: WO2005/054654

PCT Pub. Date: Jun. 16, 2005

(65) Prior Publication Data

US 2008/0168768 A1 Jul. 17, 2008

(30) Foreign Application Priority Data

Dec. 5, 2003 (GB) ..... 0328292.8

(51) Int. Cl.
*F01B 29/10* (2006.01)

(52) U.S. Cl. ..... 60/524; 60/523; 60/517

(58) Field of Classification Search ..... 60/517–526
See application file for complete search history.

(56) References Cited

U.S. PATENT DOCUMENTS 4,231,222 A 11/1980 Fenton ..... 60/524
4,248,377 A * 2/1981 Jakobsen ..... 236/68 B
4,630,447 A * 12/1986 Webber ..... 60/712
4,881,372 A * 11/1989 Naito ..... 60/521
5,440,667 A * 8/1995 Simpson et al. ..... 392/314
6,286,310 B1 9/2001 Conrad ..... 60/520
6,381,958 B1 5/2002 Kamen et al. ..... 60/517
6,536,207 B1 3/2003 Kamen et al. ..... 60/39.6
6,705,081 B2 * 3/2004 Kamen et al. ..... 60/521
2001/0032452 A1 10/2001 Kamen et al. ..... 60/39.6
2003/0145590 A1 8/2003 Langenfeld ..... 60/517

FOREIGN PATENT DOCUMENTS

GB 1 332 767 10/1973
GB 2 046 440 11/1980
WO PCT/GB2003/00208 7/2003
WO WO 03/098025 * 11/2003

* cited by examiner

*Primary Examiner*—Hoang M Nguyen
(74) *Attorney, Agent, or Firm*—Ballard Spahr LLP

(57) ABSTRACT

A Stirling engine assembly comprising a Stirling engine having a generally cylindrical head. An annular burner surrounds the head and defines a combustion chamber between the burner and head. An annular seal between the burner and head provides a seal for combustion gases. A thermocouple housing is in thermal contact with the head and sealed from the combustion chamber. The thermocouple housing extends out of the combustion chamber, with the interface between the thermocouple housing and combustion chamber being sealed. The thermocouple housing has an opening outside the combustion chamber. A thermocouple in the thermocouple housing extends from a location adjacent to the head out of the opening in the thermocouple housing.

6 Claims, 2 Drawing Sheets

STIRLING ENGINE ASSEMBLY

CROSS REFERENCE TO RELATED APPLICATIONS

The present application claims priority to Great Britain Patent Application No. 0328292.8, filed Dec. 5, 2003, which application is incorporated herein fully by this reference.

The present invention relates to a Stirling engine assembly.

Stirling engines are known which have a Stirling engine burner surrounding a substantially cylindrical heater head, which may be provided with heat transfer fins. For certain applications, it is desirable to monitor the metal temperature of the head in order to ensure that it is maintained at a safe level so that material degradation does not occur. Excessive metal temperatures accelerate oxidation of the metal and, in the case of a Stirling engine having brazed fins, will tend to degrade the braze fixing the fins to the head. This degradation will reduce the effectiveness of the heat transfer from the burner gases to the Stirling engine with a resultant reduction in engine efficiency. In addition, under normal operation, the temperature of the surface of the heater head is directly related to the quantity of heat transferred into the gas within the heater head, which is in turn related to the generated power output. The heater head metal temperature can therefore be used as an engine control parameter. For this to be possible an accurate measurement of the metal temperature is required.

Due to the hostile environment within the burner region, the expected life of a low-cost temperature sensor is limited (anticipated to be around three years). A sensor designed to survive the lifetime of the engine/burner assembly (around ten years) without replacement will therefore need to be of a higher reliability, high cost design. Such a sensor is prohibitably expensive for a Domestic Combined Heat and Power (DCHP) system.

The heated head of the Stirling engine is fully enclosed by the burner assembly which will generally include an associated recuperator. This assembly must remain sealed to prevent leakage of harmful combustion gases into the appliance so that access to this region is not possible.

The use of a thermocouple to measure the temperature of a Stirling engine head is known in the art for example in GB 1332767, GB 2046440, U.S. Pat. No. 4,231,222 and U.S. Pat. No. 4,881,372. However, all of these designs relate to Stirling engines in which the working fluid is passed through transfer tubes and are not concerned with Stirling engines with cylindrical heads surrounded by an annular burner as in the present invention.

U.S. Pat. No. 6,381,958 discloses a Stirling engine with a cylindrical head which uses a thermocouple to monitor the temperature of the head. However, in this case the burner is positioned above the engine head and fires down on to the top of the head. Thus, the domed head of the engine is the hottest part, while the cylindrical wall surrounding the dome quickly becomes significantly cooler away from the head. In U.S. Pat. No. 6,381,958 the leads from the thermocouple are shown exposed at the bottom end of the combustion chamber. This design is not appropriate to a cylindrical head surrounded by an annular burner as the combustion chamber will still be very hot at this point. Further, U.S. Pat. No. 6,381,958 contains no indication of if and how the thermocouple is removed.

Thus, the present invention aims to provide a Stirling engine with a generally cylindrical head surrounded by an annular burner which is sufficiently robust to withstand the high temperatures associated with being directly in the path of the hottest gases leaving the burner, and which can readily be removed and replaced during maintenance.

According to the present invention a Stirling engine assembly comprises a Stirling engine having a generally cylindrical head, an annular burner surrounding the head and defining a combustion chamber between the burner and head, an annular seal between the burner and head to provide a seal for combustion gases, a thermocouple housing in thermal contact with the head and sealed from the combustion chamber, the thermocouple housing extending out of the combustion chamber, with the interface between the thermocouple housing and combustion chamber being sealed, the thermocouple housing having an opening outside the combustion chamber, and a thermocouple in the thermocouple housing extending from a location adjacent to the head out of the opening in the thermocouple housing.

Providing a thermocouple housing which is sealed to the combustion chamber, and open outside of the combustion chamber allows easy access to the thermocouple housing allowing simple replacement of the thermocouple during routine maintenance. Also, the thermocouple is entirely shielded by the housing within the combustion chamber so that it can function despite being positioned directly in the path of the hot gases leaving the annular burner.

Preferably, the Stirling engine has a plurality of rows of fins surrounding the head. In this case, at least one row is preferably provided with an orifice to allow the thermocouple housing to pass therethrough. Preferably, this orifice is located adjacent to the engine head, such that the housing passes through the at least one fin adjacent to the head.

Preferably, an annular plate surrounds and is sealed to the head beneath the burner, and the thermocouple housing extends through and is brazed to the plate to provide the seal for combustion gas. Insulation is also preferably provided between the burner and the plate, with the thermocouple housing extending through the insulation. The thermocouple may be retained in the housing in a number of ways for example by a cap through which the thermocouple extends and is retained. However, preferably, the thermocouple is retained in the housing by a spring clip.

An example of a Stirling engine assembly in accordance with the present invention will now be described with reference to the accompanying drawings, in which.

Figure 1:
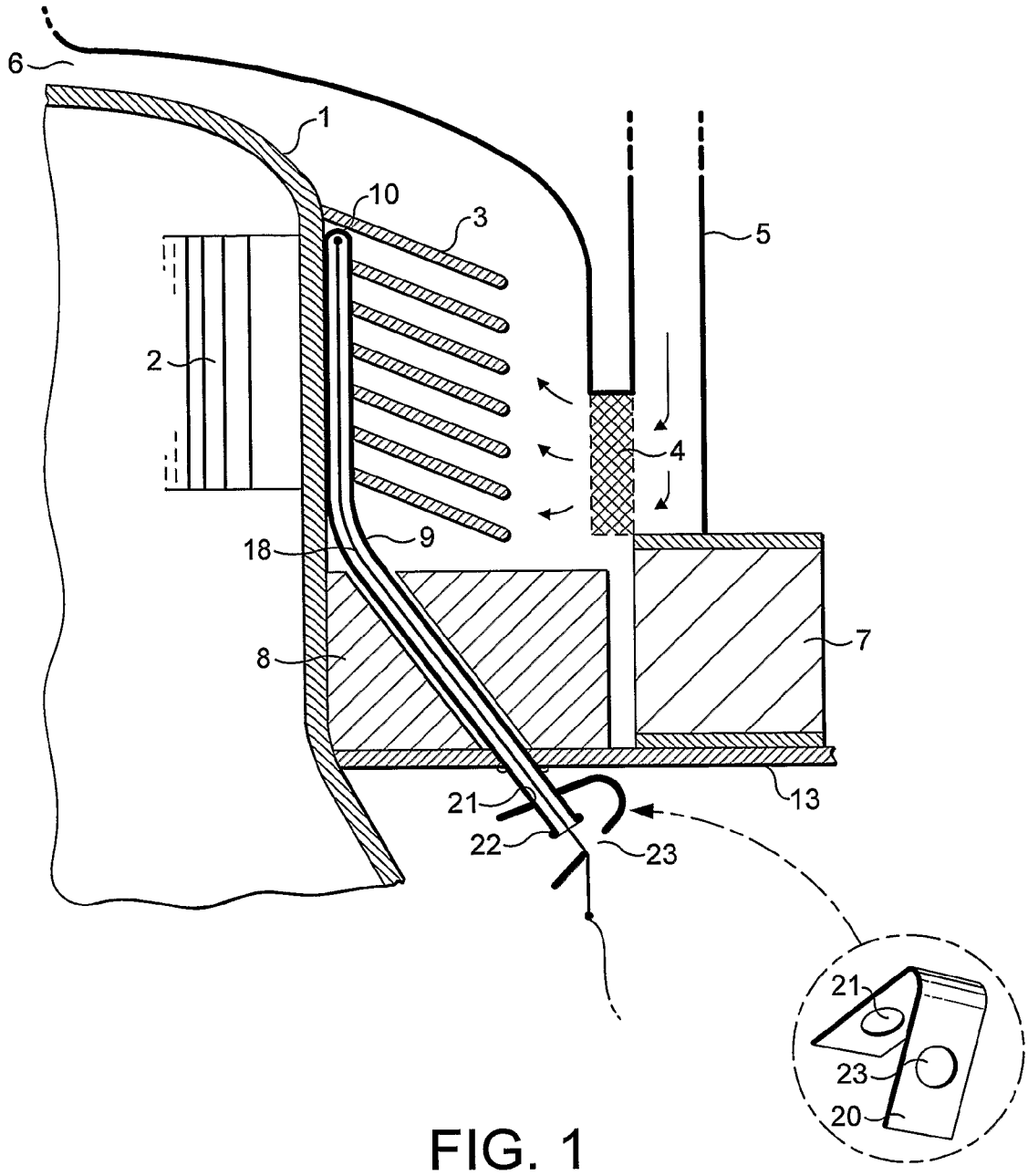
FIG. 1 is a cross-section through the right hand side of a Stirling engine head.

In most respects, the Stirling engine is known in the art, for example from PCT/GB03/00208. The engine comprises a head 1 with a plurality of internal fins 2 surrounding the inner surface of the head, and a plurality of rows of fins 3 surrounding the exterior of the head. These fins have a generally truncated frustoconical configuration and are arranged along the main axis of the head. The fins are surrounded by an annular burner 4. Gases to the burner are supplied along combustion gas inlet path 5 so that the exhaust gases pass around the top of the head 1 and pass out through exhaust duct 6. Beneath the fins 3 and burner 4 is an annular seal assembly 7 which is provided to prevent the escape of combustion gases into the atmosphere. The seal assembly forms the subject of our earlier application WO 03/098025. A block of insulation 8 is situated generally in between the burner 4 and seal 7 to insulate the seal 7 from the hot combustion gases in the combustion chamber.

A thermocouple housing 9 made of stainless steel and having a closed upper end 10 extends from a location abutting the engine head 1 just below the uppermost row of fin 3 down through all of the remaining rows, and then downwardly and outwardly away from the engine through the insulation 8. The thermocouple housing 9 extends through the insulation 8 extends through and is brazed to an engine sealing plate 13.

It is possible that, for ease of manufacture, the Stirling engine heater head casing may be constructed of upper and lower portions, joined by a weld below the fin area. In such a case a two piece design of thermocouple housing is preferred, with an upper tube brazed to the head, extending to just below the fins. This will allow access for the welding process to be performed to join upper and lower head portions, before a lower housing tube is pushed onto the upper housing, extending upwards through a hole in the sealing plate 13. Due to the potential for combustion gases to enter the housing through the join between upper and lower tubes, it is then necessary for a seal to be installed at its lower end, where the thermocouple element enters the housing. An appropriate end cap, with for example a screw thread or bayonet fitting, with gaskets to seal, would serve this purpose. In order to prevent combustion gas leakage, a seal such as a gasket is also required where the lower housing passes through the flange.

A thermocouple element 18 extends all the way along the thermocouple housing 9 from the end 10 which is in thermal contact with the head and emerges at the opposite end.

The thermocouple 18 is held in place by a spring clip 20 shown as part of FIG. 1, also separately in FIG. 1 as a perspective view. The spring clip has a first orifice 21 that is large enough to fit over an annular lip 22 on the open end of the thermocouple housing 9. The orifice 21 is fitted over the end of thermocouple housing 9 in a direction perpendicular to the longitudinal axis of the housing. Once in place, the clip then twists so that it is no longer able to pass over the lip 22. The second orifice 23 on the opposite side of the spring clip 20 to the first orifice 21 receives the thermocouple 18. The natural spring action of the clip holds the thermocouple element in position. To remove the spring clip in order to replace the thermocouple 18, the two sides of the clip are compressed to release the element.

Figure 2:
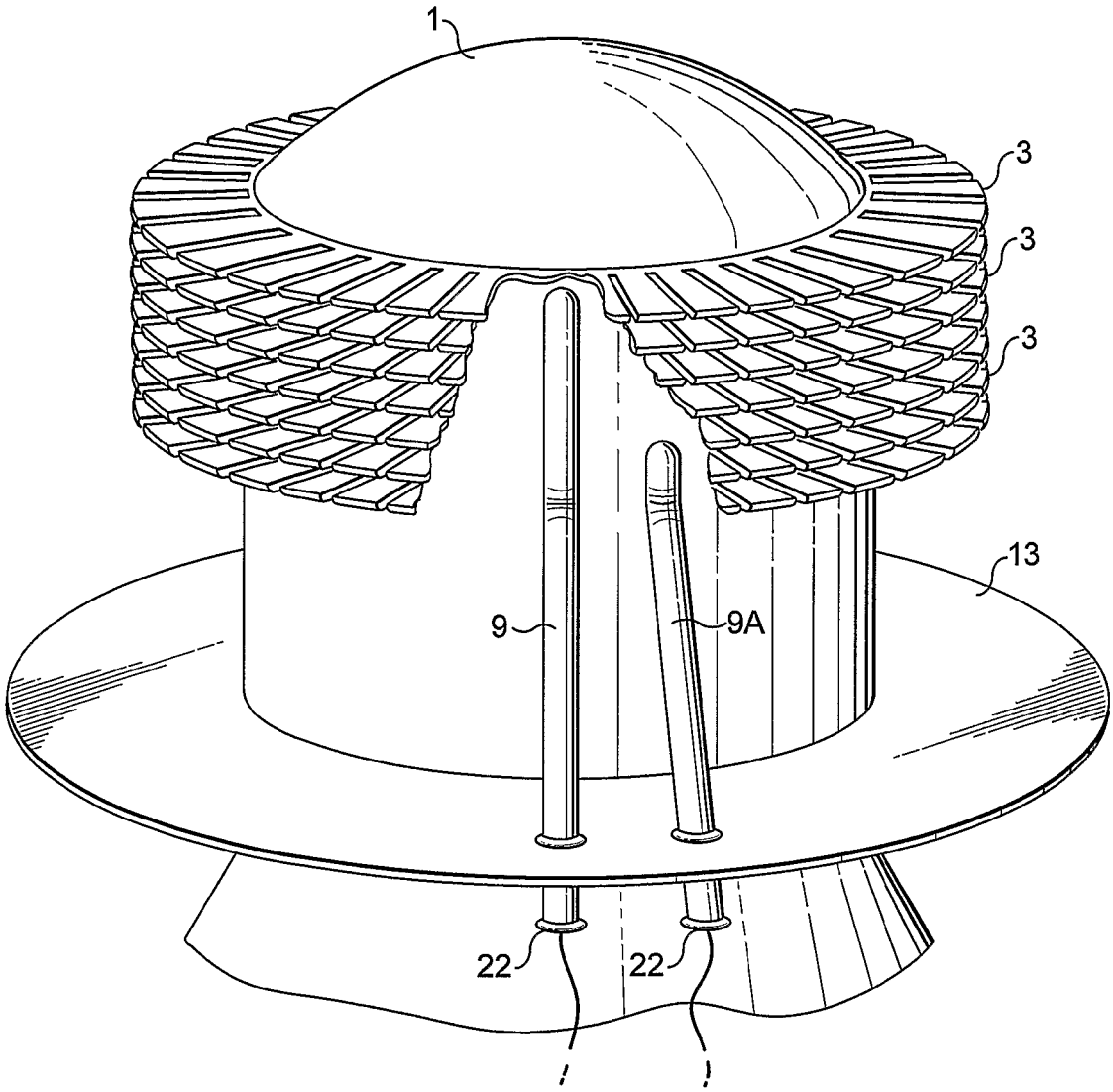
FIG. 2 is a schematic perspective view of the engine head.

In practice, a second such thermocouple housing 9 of terminating lower down the head will be provided close to the first housing (as shown in FIG. 2) as two independent sensors (for overheat and control) are required.

In order to assemble the device, the two thermocouple housings 9 are brazed in place. Each row of heat transfer fins 3 (with the exception of the top row) is provided with a cut-out portion to accommodate the thermocouple housing 10. The fins are, for example, stainless steel, inconel, or aluminium bronze. These are placed over the head 1 and brazed in place. This can be carried out by either "wetting" the inner surface of the fins with a braze compound, or coating with a slurry using an airgun before installation. Alternatively, a pre-formed "washer" of brazing compound is installed between the fin and the heating head. Upon heating to a temperature suited to the specific braze compound, a uniform brazed joint is formed with optimal heat transfer properties. The cut out portion may be formed before the fins are brazed in place, or afterwards to avoid any misalignments problems between adjacent rows. With the thermocouple housing in place, blocks of insulation are fitted in place and have appropriate recesses to accommodate the thermocouple housing 9.

Alternatively, the thermocouple housing 10 and fins 3 can be brazed in a single operation. The sealing plate 13 may also be brazed at the same time. This operation may also include brazing the internal copper fins 2. In order to do this, the components have to be put together in an assembly jig to ensure correct alignment before heating the components to the required temperature thereby forming all of the joints in a single process.

An alternative design is shown in FIGS. 2 and 3 in which similar components have been designated with the same reference numbers. FIG. 2 shows the two thermocouple housings 9, 9A referred to in respect of FIG. 1, but not illustrated.

The invention claimed is:

1. A Stirling engine assembly comprising a Stirling engine having a generally cylindrical head, an annular burner surrounding the head and defining a combustion chamber between the burner and head, an annular seal between the burner and head to provide a seal for combustion gases, a thermocouple housing in thermal contact with the head and sealed from the combustion chamber, the thermocouple housing extending out of the combustion chamber, with the interface between the thermocouple housing and combustion chamber being sealed, the thermocouple housing having an opening outside the combustion chamber, and a thermocouple in the thermocouple housing extending from a location adjacent to the head out of the opening in the thermocouple housing;

wherein the Stirling engine has a plurality of rows of fins surrounding the head; and wherein at least one row is provided with an orifice to allow the thermocouple housing to pass therethrough.

2. A Stirling engine assembly according to claim 1, wherein the orifice is located adjacent to the engine head, such that the housing passes through the at least one fin adjacent to the head.

3. A Stirling engine assembly according to claim 1, wherein annular plate surrounds and is sealed to the head beneath the burner, and wherein the thermocouple housing extends through and is brazed to the plate to provide the seal for combustion gases.

4. A Stirling engine assembly according to claim 3, wherein insulation is provided between the burner and the plate, with the thermocouple housing extending through the insulation.

5. A Stirling engine assembly comprising a Stirling engine having a generally cylindrical head, an annular burner surrounding the head and defining a combustion chamber between the burner and head, an annular seal between the burner and head to provide a seal for combustion gases, a thermocouple housing in thermal contact with the head and sealed from the combustion chamber, the thermocouple housing extending out of the combustion chamber, with the interface between the thermocouple housing and combustion chamber being sealed, the thermocouple housing having an opening outside the combustion chamber, and a thermocouple in the thermocouple housing extending from a location adjacent to the head out of the opening in the thermocouple housing, wherein the thermocouple is retained in the thermocouple housing by a spring clip.

6. A Stirling engine assembly comprising a Stirling engine having a generally cylindrical head, an annular burner surrounding the head and defining a combustion chamber between the burner and head, an annular seal between the burner and head to provide a seal for combustion gases, a thermocouple housing in thermal contact with the head and sealed from the combustion chamber, the thermocouple housing extending out of the combustion chamber, with the interface between the thermocouple housing and combustion chamber being sealed, the thermocouple housing having an opening outside the combustion chamber, and a thermocouple in the thermocouple housing extending from a location adjacent to the head out of the opening in the thermocouple housing, further comprising a second thermocouple housing in thermal contact with the head and sealed from the combustion chamber, the second thermocouple housing extending out of the second combustion chamber, with the interface between the second thermocouple housing and combustion chamber being sealed, the second thermocouple housing having an opening outside the combustion chamber, and a second thermocouple in the second thermocouple housing extending from a location adjacent to the head out of the opening in the second thermocouple housing.

* * * * *